US010782724B1

(12) United States Patent
Metzmeier

(10) Patent No.: US 10,782,724 B1
(45) Date of Patent: Sep. 22, 2020

(54) SLIDING RING FOR KNOB ON HOME APPLIANCE

(71) Applicants: BSH Home Appliances Corporation, Irvine, CA (US); BSH Hausgeräte GmbH, Munich (DE)

(72) Inventor: Holger Metzmeier, Ötigheim (DE)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 0 days.

(21) Appl. No.: 16/452,576

(22) Filed: Jun. 26, 2019

(51) Int. Cl.
*G05G 1/10* (2006.01)
*F24C 7/08* (2006.01)

(52) U.S. Cl.
CPC ..... *G05G 1/105* (2013.01); *F24C 7/08* (2013.01)

(58) Field of Classification Search
CPC ..... G05G 1/105; F24C 7/08
See application file for complete search history.

(56) References Cited

U.S. PATENT DOCUMENTS

| | | | | |
|---|---|---|---|---|
| 4,807,091 | A * | 2/1989 | Obata | G05G 1/105 116/286 |
| 9,330,863 | B2 | 5/2016 | Pfau et al. | |
| 9,786,453 | B2 | 10/2017 | Takano et al. | |
| 2014/0047943 | A1 | 2/2014 | Camli et al. | |
| 2014/0056022 | A1* | 2/2014 | Camli | F24C 7/082 362/551 |
| 2017/0213670 | A1 | 7/2017 | Okano | |
| 2017/0234547 | A1 | 8/2017 | Both et al. | |
| 2018/0359819 | A1* | 12/2018 | Cadima | F24C 3/126 |

FOREIGN PATENT DOCUMENTS

| | | | |
|---|---|---|---|
| CN | 206602063 | U | 10/2017 |
| GB | 1281435 | A | 7/1972 |

* cited by examiner

*Primary Examiner* — Vicky A Johnson
(74) *Attorney, Agent, or Firm* — Michael E. Tschupp; Andre Pallapies; Brandon G. Braun

(57) ABSTRACT

A control element for controlling a function of a domestic appliance has a control knob having a circular outer periphery, the control knob having a gripping portion configured to be gripped by a user of the domestic appliance, and a shaft receiving portion that is configured to receive a shaft of the domestic appliance; and a sliding ring positionally fixed to the control knob, the sliding ring having a circular outer periphery wall surrounding the outer periphery of the control knob, a base perpendicular to the outer periphery wall, and an opening in the base configured to receive the shaft of the domestic appliance.

20 Claims, 6 Drawing Sheets

SLIDING RING FOR KNOB ON HOME APPLIANCE

FIELD OF THE INVENTION

The invention is directed to home appliances. More particularly, embodiments of the invention are directed to a home appliance control knob.

An example of an application for the invention is a control knob with a sliding ring that centers the control knob in an opening in a control panel of the home appliance.

BACKGROUND OF THE INVENTION

Some modern domestic kitchens include appliances such as, for example, cooking appliances that have control knobs that are operable by a user of the appliance to control a function of the appliance. Some of such control knobs extend through openings in a control panel of the appliance.

Applicants recognized an improvement to the above arrangement and implement that improvement in embodiments of the invention.

SUMMARY

The invention achieves the benefit of locating a control knob in an opening in a control panel such that the control knob operates smoothly and provides the esthetic benefit of being centered in the opening. In many modern kitchen cooking appliances, particularly gas cooking appliances, centering control knobs in openings in a control panel can be challenging. This is particularly the case when the control knob extends into the opening and does not cover an edge of the opening, thus leaving exposed a gap between an outer periphery of the control know and an edge of the opening.

Particular embodiments of the invention are directed to a domestic appliance, having: a main housing; a control panel attached to the main housing; a knob opening in the control panel, the knob opening having an edge; a control knob partially located in the knob opening, the control knob having an outer periphery; and a sliding ring positioned between the outer periphery of the control knob and the edge of the knob opening.

In some embodiments, the sliding ring has an outer periphery and an inner surface, the outer periphery of the sliding ring contacts the edge of the knob opening around an entirety of the outer periphery of the sliding ring, and the outer periphery of the control knob contacts the inner surface of the sliding ring around an entirety of the outer periphery of the control knob.

Other embodiments of the invention are directed to a control element for controlling a function of a domestic appliance, the control element having: a control knob having a circular outer periphery, the control knob having a gripping portion configured to be gripped by a user of the domestic appliance, and a shaft receiving portion that is configured to receive a shaft of the domestic appliance; and a sliding ring positionally fixed to the control knob, the sliding ring having a circular outer periphery wall surrounding the outer periphery of the control knob, a base perpendicular to the outer periphery wall, and an opening in the base configured to receive the shaft of the domestic appliance.

Other embodiments of the invention are directed to a control unit for a domestic appliance, the control unit having: a control panel configured to be attached to a main housing of the domestic appliance; a knob opening in the control panel, the knob opening having an edge; a control knob partially located in the knob opening, the control knob having an outer periphery; and a sliding ring positioned between the outer periphery of the control knob and the edge of the knob opening. The sliding ring has an outer periphery and an inner surface, the outer periphery of the sliding ring contacts the edge of the knob opening around an entirety of the outer periphery of the sliding ring, and the outer periphery of the control knob contacts the inner surface of the sliding ring around an entirety of the outer periphery of the control knob.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the exemplary embodiments and further features and advantages thereof may be acquired by referring to the following description taken in conjunction with the accompanying drawings, wherein.

DETAILED DESCRIPTION

The invention is described herein with reference to the accompanying drawings in which exemplary embodiments of the invention are shown. The invention may, however, be embodied in many different forms and should not be construed as limited to the embodiments set forth herein.

As explained above, embodiments of the invention provide an improvement to appliances that have a control knob that extends into an opening in a control panel such that the control knob does not cover an edge of the opening. Embodiments of the invention improve this configuration by providing a sliding ring between an outer periphery of the control knob and an edge of the opening. The sliding ring centers, or substantially centers, the control knob in the opening while also providing a smooth operation of the control knob, both of which improve the quality of the appearance and feel of the control knob and appliance.

Control knobs and knob housings of some ranges and range-tops are die casted parts, which are quite solid and heavy. The concentricity between these big, heavy knobs and the knob bezels is sometimes not easily adjustable and the operation of the knobs can seem to be imprecise. In some cases, during the assembly process, the knob bezels are driven forcefully, to a more or less concentric position.

Sliding rings in accordance with embodiments of the invention keep the knob in a concentric position relative to its bezel and/or opening in the control panel. The manual operation (turning the knob) gives a better feeling because the knob is guided around the outer diameter and there is less force on the knob's shaft while turning the knob. The sliding ring can be made of a material with a very low coefficient of friction, e.g. PTFE. The sliding ring can have a chamfer on the outer diameter for easy insertion into the bezel and/or opening in the control panel. The sliding ring can easily be assembled on the rear edge of the knob and inserted into the bezel while pushing the knob onto its shaft.

Figure 1:
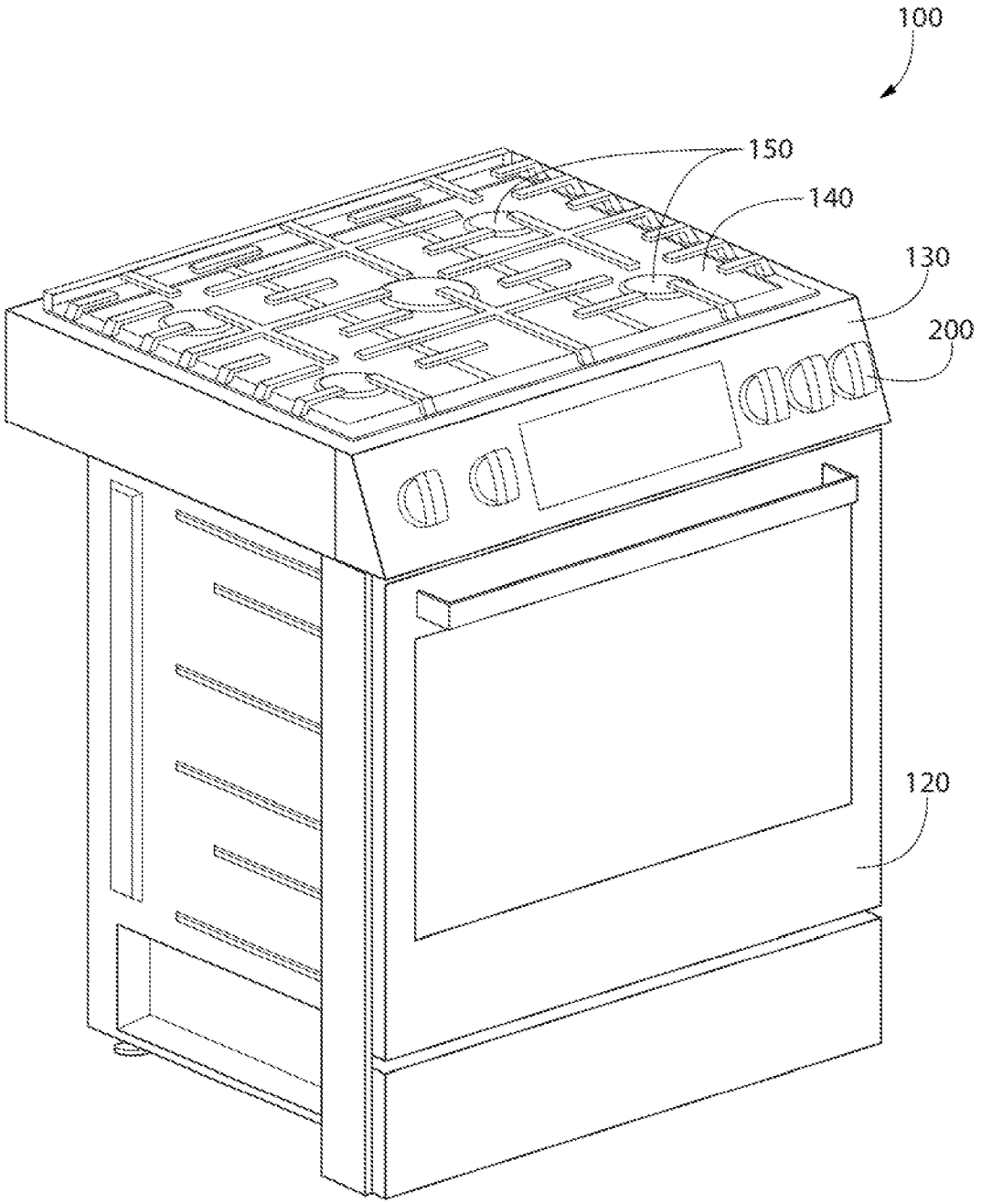
FIG. 1 is a perspective view of an appliance in accordance with exemplary embodiments of the invention.

FIG. 1 shows an appliance 100 in accordance with exemplary embodiments of the invention. In this example, appliance 100 has a door 120 that provides access to a cooking compartment, a control panel 130, a top sheet 140, and a plurality of heating elements (in this example, gas burners) 150. Also shown in FIG. 1 are a plurality of control knobs 200 used to control various functions of appliance 100. For example, each control knob 200 can control the amount of gas sent to a particular burner 150. In embodiments, one or more control knob 200 controls other features. In this example, an outer periphery of each control knob 200 extends into an opening in control panel 130 such that control knob 200 does not cover an edge of the opening.

Figure 2:
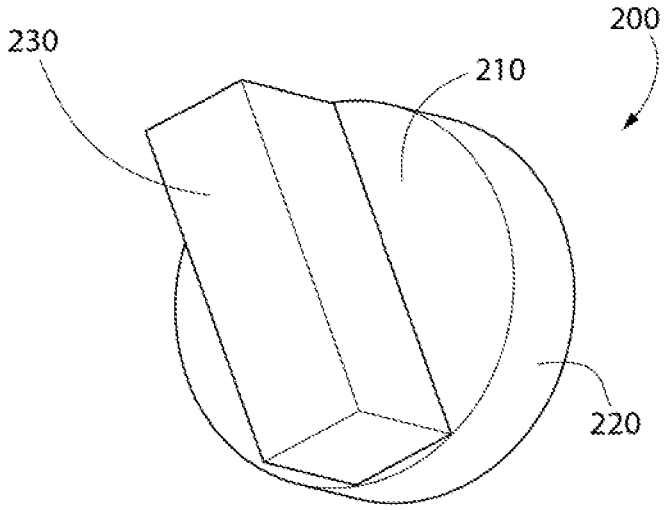
FIG. 2 is a perspective view of a control knob in accordance with exemplary embodiments of the invention.
Figure 3:
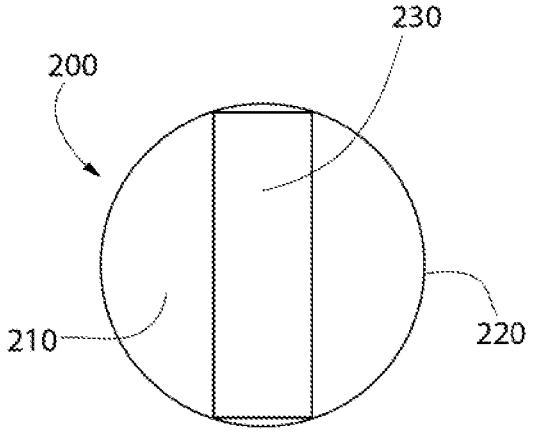
FIG. 3 is a front view of the control knob shown in FIG. 2.
Figure 4:
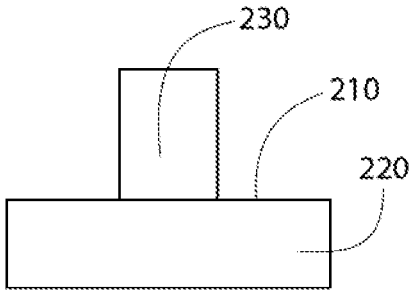
FIG. 4 is a top view of the control knob shown in FIG. 2.

FIGS. 2-4 show an example of control knob 200 in accordance with embodiments of the invention. In this example, control knob 200 has a base 210 and a grip portion 230. Base 210 has, in this example, a circular outer periphery 220 that is perpendicular to a top surface of base 210. Other embodiments of the invention include knob configurations that have outer peripheries 220 that are not perpendicular to the top surface of base 210 and/or are curved or some other shape.

Figure 5:
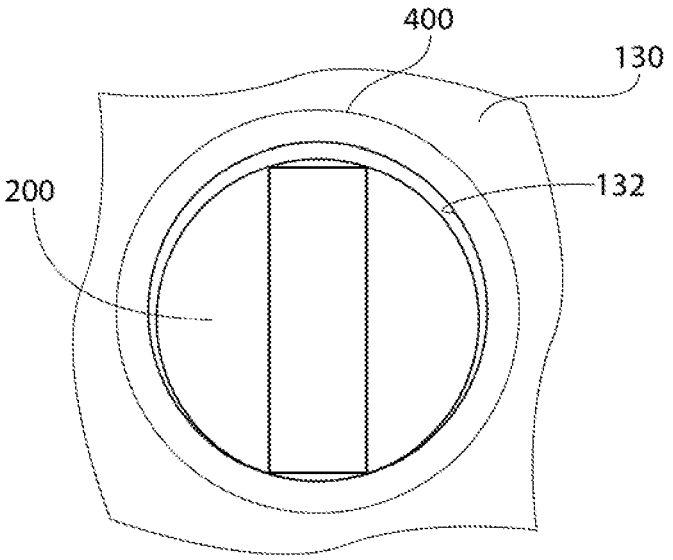
FIG. 5 is a front view of a control panel with the control knob shown in FIG. 2.

FIG. 5 shows a problem that can result from a control knob that extends into an opening in a control panel without overlapping the edge of the opening. In the example shown in FIG. 5, control knob 200 is not centrally located in the opening in control panel 130. This situation creates a non-uniform gap between an edge 132 of the opening and an outer periphery of control knob 200. The non-uniform gap can cause a frictional force between control knob 200 and edge 132 that results in more effort being required on the part of a user to turn control knob 200. This is an undesirable situation for at least the reasons that it portrays poor quality and can cause undesirable wear of control knob 200 and/or edge 132. The non-uniform gap also is esthetically undesirable.

The example shown in FIG. 5 includes a bezel 400 that surrounds the opening in control panel 130. In some embodiments, an inner surface of bezel 400 aligns with edge 132 of the opening. In other embodiments, the inner surface of bezel 400 extends over the opening beyond edge 132. In other embodiments, edge 132 extends toward the center of the opening beyond the inner surface of bezel 400. In the example shown, the inner surface of bezel 400 aligns with edge 132 of the opening. For simplicity, the reference number 132 will be used to represent the edge of the opening and an inner surface of bezel 400 in that the description regarding edge 132 applies to the inner surface of bezel 400 if bezel 400 overlaps edge 132.

Figure 6:
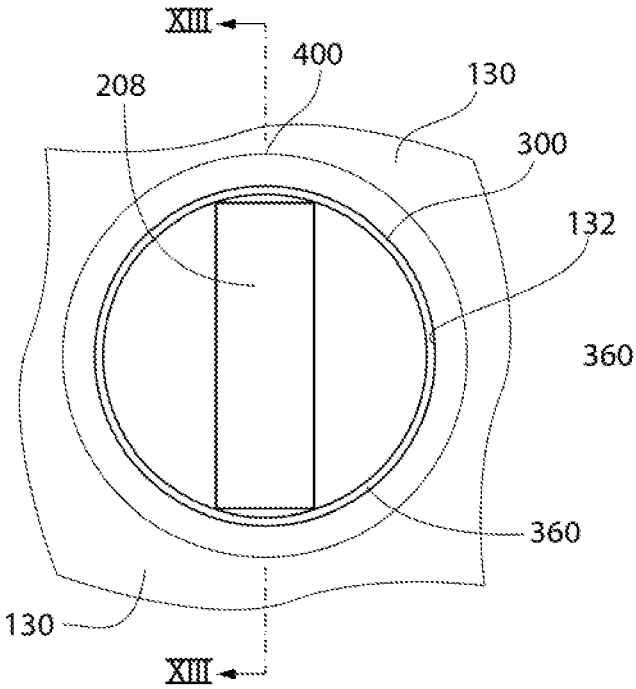
FIG. 6 is a front view of a control panel, control knob, and sliding ring in accordance with exemplary embodiments of the invention.
Figure 7:
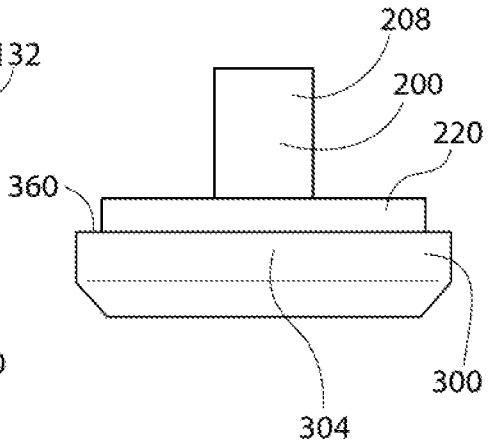
FIG. 7 is a top view of the control knob and sliding ring shown in FIG. 6.

FIGS. 6 and 7 show an example of an embodiment of the invention that includes a sliding ring 300. Sliding ring 300 is positioned around a portion of control knob 200 such that sliding ring 300 is between outer periphery 220 of control knob 200 and edge 132 of the opening in control panel 130. Sliding ring 300 is, in this example, positionally fixed to control knob 200 such that sliding ring 300 rotates with control knob 200. In this example. an outer periphery 304 of sliding ring 300 contacts edge 132 to center control knob 200 in the opening in control panel 130. In other embodiments, a small gap exists between outer periphery 304 of sliding ring 300 and edge 132. In the case where a small gap exists between outer periphery 304 of sliding ring 300 and edge 132, control knob may not be precisely centered in the opening.

In embodiments, sliding ring 300 is made of a material with a low coefficient of friction in order to promote sliding between outer periphery 304 of sliding ring 300 and edge 132. Non-limiting examples of materials that can be used for sliding ring 300 are nylon, various other polymers, and materials coated with a low friction coating. In the examples shown, sliding ring 300 is one piece of a homogenous material. Other embodiments use multiple parts of the same or different materials.

FIG. 7 shows sliding ring 300 having a rim 360 that extends radially beyond control knob 200. Rim 360 can be seen in FIG. 6 between edge 132 and outer periphery 220 of control knob 200.

Figure 8:
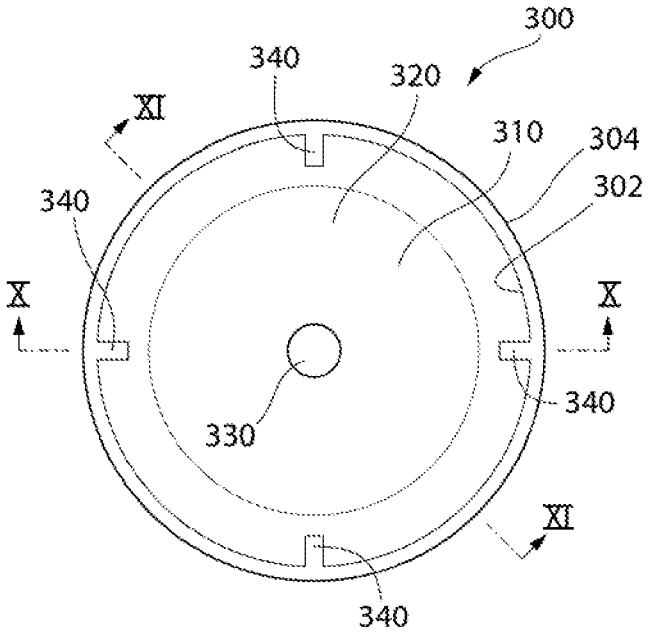
FIG. 8 is a front view of a sliding ring in accordance with exemplary embodiments of the invention.
Figure 9:
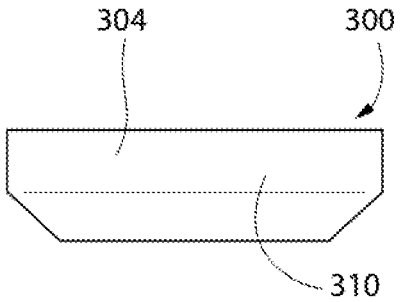
FIG. 9 is a top view of the sliding ring shown in FIG. 8.
Figure 10:
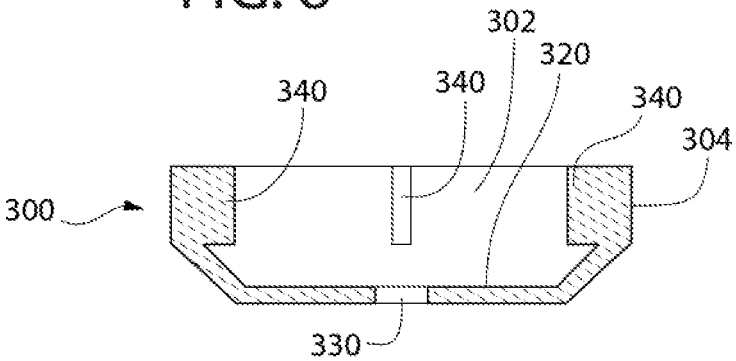
FIG. 10 is a sectional view along section line X-X in FIG. 8.
Figure 11:
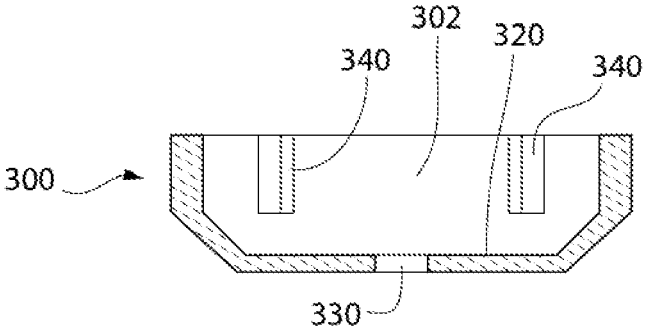
FIG. 11 is a sectional view along section line XI-XI in FIG. 8.

FIGS. 8-11 shows an example of sliding ring 300 having tabs 340 that mate with slots in control knob 200 to positionally fix sliding ring 300 relative to control knob 200. In embodiments, tabs 340 are a friction fit with the slots in control knob 200 in order to secure sliding ring 300 to control knob 200. In this example, four tabs 340 are shown. Other examples have fewer or more tabs 340. Still other examples use one or more other attachment features to positionally fix and secure sliding ring 300 to control knob 200. Also shown in FIGS. 8, 9, 10 is a hole 330 in a base portion 320 of sliding ring 300. Hole 330 is provided to allow passage of a shaft 160 (FIG. 13) of a gas valve through sliding ring 300. Other examples provide a much larger hole 330 such that the majority of base portion 320 is open. In this example, sliding ring 300 has an inner surface 302 that contacts outer periphery 220 of control knob 200 when sliding ring 300 is installed on control knob 200. In this example, a slight friction fit exists between inner surface 302 of sliding ring 300 and outer periphery 220 of control knob 200 in order to maintain a uniform and secure fit. A uniform and secure fit between inner surface 302 of sliding ring 300 and outer periphery 220 of control knob 200 helps maintain a true circular shape of outer periphery 304 of sliding ring 300. Without such a fit, outer periphery 304 of sliding ring 300 can, in some cases, tend to not maintain a true circular shape if sliding ring 300 is made of a soft and/or pliable material.

Figure 12:
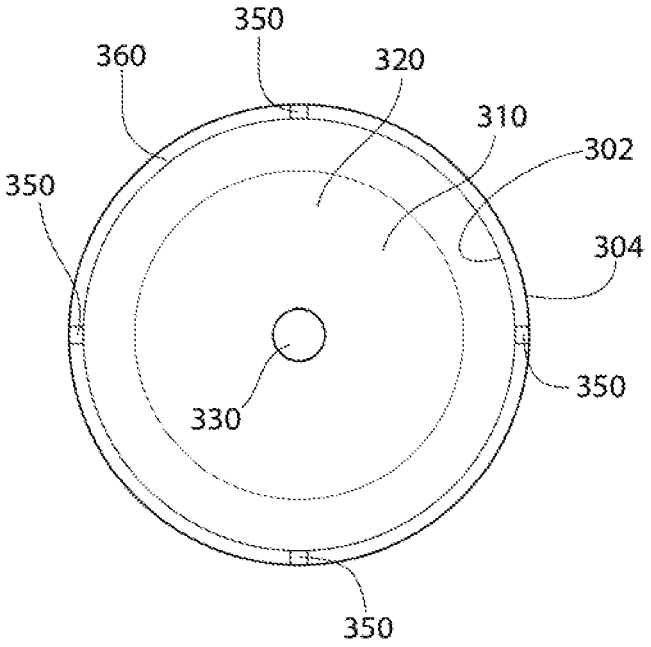
FIG. 12 is a front view of a sliding ring in accordance with exemplary embodiments of the invention.

FIG. 12 shows an alternate embodiment of sliding ring 300. In this embodiment, notches 350 are provided instead of tabs 340. In this embodiment, control knob 200 has tabs that extend from outer periphery 220 that engage notches 350. In this embodiment, the tabs on control knob 200 do not extend beyond outer periphery 304 of sliding ring 300 so as not to interfere with the smooth sliding of sliding ring 300 against edge 132.

Figure 13:
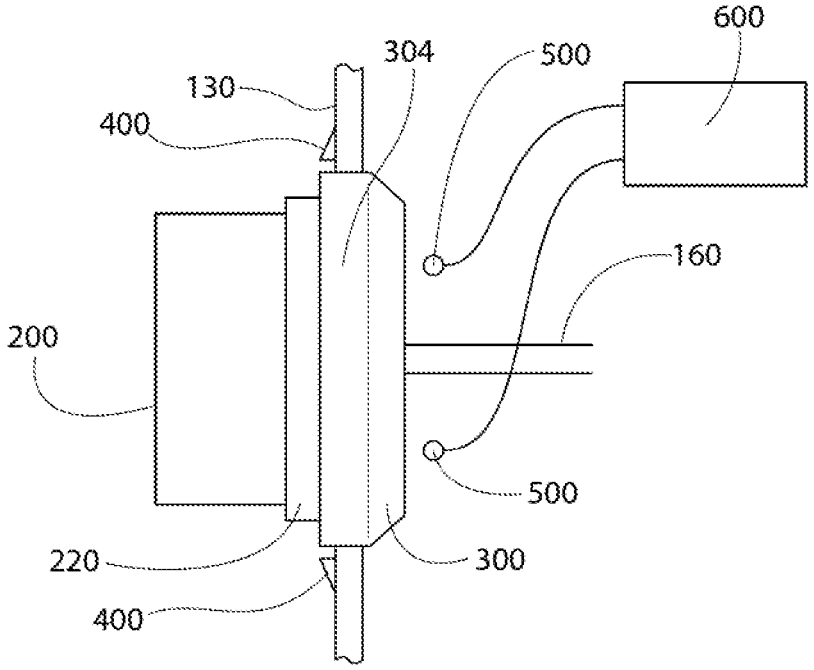
FIG. 13 is a sectional view along section line XIII-XIII in FIG. 6.

FIG. 13 shows a partial section view taken along section line XIII-XIII in FIG. 6. This view shows outer periphery 304 of sliding ring 300 contacting edge 132 of the opening in control panel 130. In other embodiments, outer periphery 304 of sliding ring 300 does not contact edge 132 of the opening in control panel 130, or contacts edge 132 in less than an entire inner surface of edge 132. This example shows an inner surface of bezel 400 extending farther in a radial direction away from shaft 160 than does edge 132. As described above, in other examples the inner surface of bezel 400 overlaps edge 132 or aligns with edge 132.

Some embodiments include a lighting feature. FIG. 13 shows two light sources 500 (such as, for example, LEDs or some other form of light emitter) located behind sliding ring 300. Also shown is a controller 600 that controls light sources 500. In embodiments, sliding ring 300 is a translucent material such that when light sources 500 emit light, light is transmitted though sliding ring 300 such that a user can see the light. Although two light sources 500 are shown in FIG. 13, it is noted that fewer or more light sources can be used. The position of light sources 500 relative to sliding ring 300 in FIG. 13 is just one example, and it is understood that light sources 500 can be located in other position.

Figures 14, 15, 16:
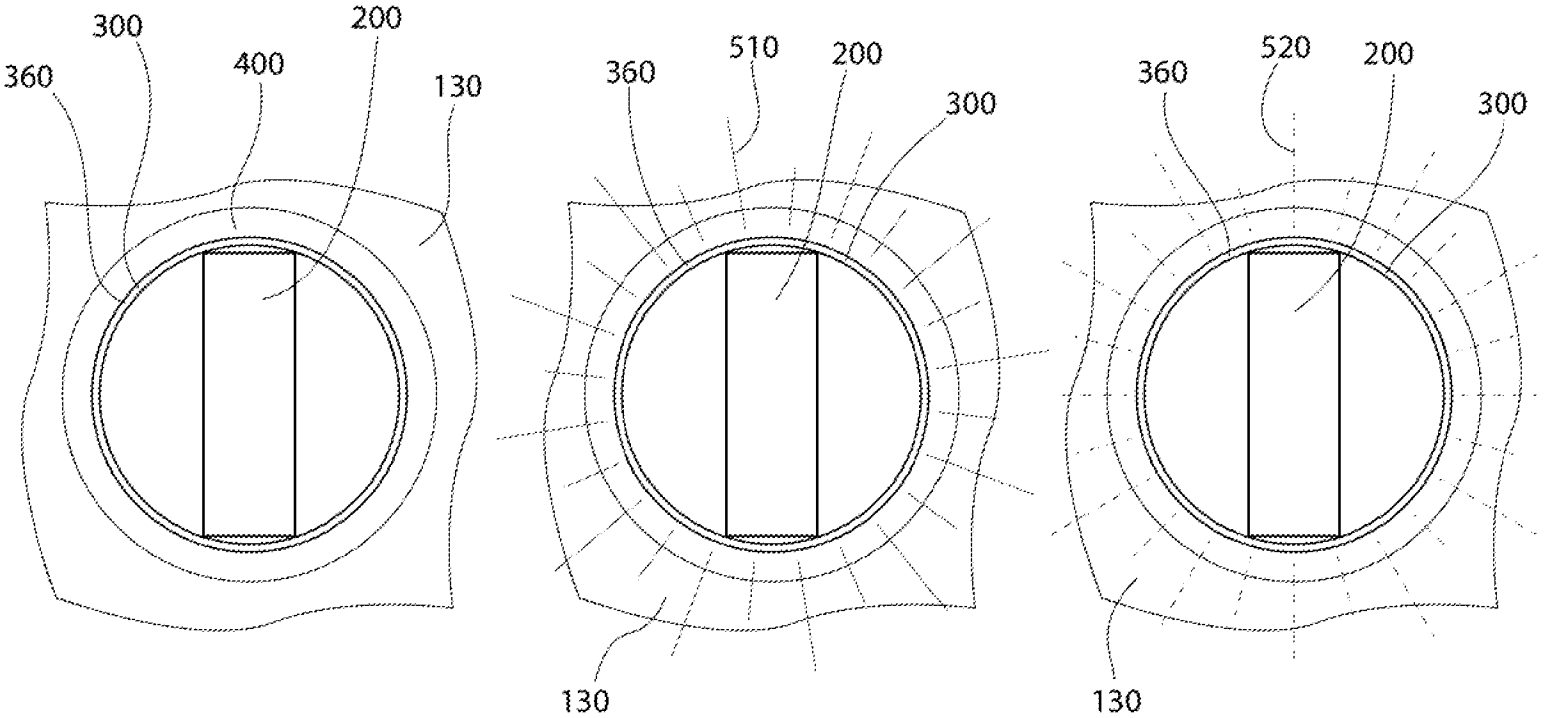
FIG. 14 is a front view of a control panel, control knob, and sliding ring in accordance embodiments of the invention with the sliding ring emitting no light.
FIG. 15 is front view of the control panel, control knob, and sliding ring shown in FIG. 13 with the sliding ring emitting constant light.
FIG. 16 is front view of the control panel, control knob, and sliding ring shown in FIG. 13 with the sliding ring emitting blinking light.

FIGS. 14-16 show three states of embodiments of the invention. In FIG. 14, light sources 500 are not emitting light. In embodiments, this state corresponds to a burner on a gas stove being in the OFF position. The state shown in FIG. 14 can also, or alternatively, correspond to other states and/or conditions of the appliance. In FIG. 15, light sources 500 are emitting a constant light (not flashing). In embodiments, this state corresponds to a burner on a gas stove being in a MAX ON position. The state shown in FIG. 15 can also, or alternatively, correspond to other states and/or conditions of the appliance. In FIG. 16, light sources 500 are emitting an intermittent light (flashing). In embodiments, this state corresponds to a burner on a gas stove being in a LOW or SIMMER position. The state shown in FIG. 16 can also, or alternatively, correspond to other states and/or conditions of the appliance.

In embodiments, light sources 500 are capable of emitting light having different colors. In some of these embodiments, a light of a first color corresponds to a first state of the appliance and a light of a second color corresponds to a second state of the appliance. In some of these embodiments, a light of a first color corresponds to a first control function (such as, for example, temperature) of the appliance and a light of a second color corresponds to a second control function (such as, for example, a timer) of the appliance.

In embodiments, bezel 400 is made of a material through which light can pass. In such embodiments, the light emitted from light sources 500 is visible through bezel 400. In embodiments, one or both of bezel 400 and sliding ring 300 are made of a material through which light can pass. Further, in embodiments in which both bezel 400 and sliding ring 300 are made of a material through which light can pass, different light sources 500 can be provided for each of bezel 400 and sliding ring 300 such that they can be lighted differently (flashing/constant/colors).

It will be appreciated that variants of the above-disclosed and other features and functions, or alternatives thereof, may be combined into many other different systems or applications. Any of the features described above can be combined with any other feature described above as long as the combined features are not mutually exclusive. Various presently unforeseen or unanticipated alternatives, modifications, variations or improvements therein may be subsequently made by those skilled in the art which are also intended to be encompassed by the invention.

What is claimed is:

1. A domestic appliance, comprising:
a main housing;
a control panel attached to the main housing;
a knob opening in the control panel, the knob opening having an edge;
a control knob partially located in the knob opening, the control knob having an outer periphery; and
a sliding ring positioned between the outer periphery of the control knob and the edge of the knob opening,
wherein the sliding ring is engaged with the control knob.

2. The domestic appliance of claim 1, wherein the sliding ring has an outer periphery and an inner surface.

3. The domestic appliance of claim 2, wherein the outer periphery of the sliding ring is concentrically located in the knob opening.

4. The domestic appliance of claim 3, wherein the outer periphery of the control knob contacts the inner surface of the sliding ring around an entirety of the outer periphery of the control knob.

5. The domestic appliance of claim 4, wherein the sliding ring is positionally fixed to the control knob.

6. The domestic appliance of claim 5, wherein the sliding ring is a translucent material.

7. The domestic appliance of claim 3, wherein the outer periphery of the sliding ring and the edge of the knob opening are concentric.

8. The domestic appliance of claim 7, wherein the outer periphery of the control knob contacts the inner surface of the sliding ring around an entirety of the outer periphery of the control knob.

9. The domestic appliance of claim 1, wherein the outer periphery of the sliding ring contacts the edge of the knob opening around an entirety of the outer periphery of the sliding ring.

10. The domestic appliance of claim 9, further comprising
a light source located behind the sliding ring; and
a controller that controls light emitted by the light source,
wherein the sliding ring is a translucent material such that the light emitted from the light source is visible from outside of the control panel.

11. The domestic appliance of claim 10, wherein the controller controls the light source to emit a first light signal corresponding to a first function of the control knob,
the controller controls the light source to emit a second light signal corresponding to a second function of the control knob, and
the first light signal and the second light signal are different.

12. The domestic appliance of claim 11, wherein the first light signal is a first color and the second light signal is a second color.

13. The domestic appliance of claim 11, wherein the first light signal comprises the light source being constantly lit, and the second light signal comprises the light source flashing.

14. The domestic appliance of claim 11, further comprising the engagement of the sliding ring with the control knob occurring via a plurality of tabs on the sliding ring mating with a plurality of slots on the control knob.

15. The domestic appliance of claim 1, wherein the sliding ring has an outer periphery and an inner surface, the outer periphery of the sliding ring contacts the edge of the knob opening around an entirety of the outer periphery of the sliding ring, and the outer periphery of the control knob contacts the inner surface of the sliding ring around an entirety of the outer periphery of the control knob.

16. A control element for controlling a function of a domestic appliance, the control element comprising:

a control knob having a circular outer periphery, the control knob having a gripping portion configured to be gripped by a user of the domestic appliance, and a shaft receiving portion that is configured to receive a shaft of the domestic appliance; and a sliding ring engaged with the control knob, the sliding ring having a circular outer periphery wall surrounding the outer periphery of the control knob, a base perpendicular to the outer periphery wall, and an opening in the base configured to receive the shaft of the domestic appliance.

17. The control element of claim 16, wherein the sliding ring is a translucent material.

18. The control element of claim 17, wherein the sliding ring is one homogeneous piece of the translucent material.

19. The control element of claim 16, wherein the sliding ring is one homogeneous piece of material.

20. A control unit for a domestic appliance, the control unit comprising:

a control panel configured to be attached to a main housing of the domestic appliance;

a knob opening in the control panel, the knob opening having an edge;

a control knob partially located in the knob opening, the control knob having an outer periphery; and a sliding ring engaged with the control knob and positioned between the outer periphery of the control knob and the edge of the knob opening, wherein the sliding ring has an outer periphery and an inner surface, the outer periphery of the sliding ring contacts the edge of the knob opening around an entirety of the outer periphery of the sliding ring, and the outer periphery of the control knob contacts the inner surface of the sliding ring around an entirety of the outer periphery of the control knob.

* * * * *